US007497683B2

(12) United States Patent
Benson

(10) Patent No.: US 7,497,683 B2
(45) Date of Patent: Mar. 3, 2009

(54) TWO WAY TOOL FOR LIGHTING AND EXTINGUISHING CANDLES

(76) Inventor: Robert E. Benson, 1166 Newport Rd., Raphine, VA (US) 24472

( * ) Notice: Subject to any disclaimer, the term of this patent is extended or adjusted under 35 U.S.C. 154(b) by 300 days.

(21) Appl. No.: 11/163,654

(22) Filed: Mar. 6, 2006

(65) Prior Publication Data

US 2007/0207424 A1 Sep. 6, 2007

(51) Int. Cl.
*F23Q 25/00* (2006.01)
*B25B 7/22* (2006.01)

(52) U.S. Cl. ..... 431/144; 431/146; 431/269; 431/287; 431/288

(58) Field of Classification Search ..... 431/144, 431/146, 269, 288, 287
See application file for complete search history.

(56) References Cited

U.S. PATENT DOCUMENTS 155,793 A * 10/1874 Davis ..... 431/269
1,740,623 A * 12/1929 Payne ..... 431/144
2,510,854 A * 6/1950 Bell ..... 431/269
2,785,556 A 3/1957 Smith
3,985,492 A * 10/1976 Nunemaker ..... 431/144
D330,784 S 11/1992 Zuffoletti
5,344,309 A * 9/1994 Phare ..... 431/145
D406,409 S 3/1999 Rubino
6,929,466 B1 * 8/2005 Reese ..... 431/143
7,415,744 B1 * 8/2008 Williams ..... 7/128

* cited by examiner

*Primary Examiner*—Steven B McAllister
*Assistant Examiner*—Nikhil Mashruwala
(74) *Attorney, Agent, or Firm*—Theresa M Seal

(57) ABSTRACT

A dual use or two-way tool for lighting and extinguishing candles includes an arcuate tubular member having a candle snuffing portion terminating with a cone-shaped candle snuffing member for extinguishing the candle flame and an opposite candle lighting portion terminating with an integrally formed secondary jaw that cooperates with a primary jaw pivotally mounted to the tubular member and in alignment with the secondary jaw whereupon the jaws cooperate to hold a match for lighting the candlewick and for releasing the match for disposal after lighting, with the jaws actuated through a release and return spring, and the jaws including front and side apertures for receiving and holding therein the match so that the candlewick can be lit straight on and also at 90 degrees angles relative to the extension of the jaws thereby enabling the lighting of candlewicks for candles emplaced in deep candle holders.

11 Claims, 6 Drawing Sheets

TWO WAY TOOL FOR LIGHTING AND EXTINGUISHING CANDLES

The present invention pertains to devices for lighting wicks and extinguishing flames, and more particularly pertains to a dual use tool that allows an individual to safely light and extinguish the wick of a candle.

BACKGROUND OF THE INVENTION

Despite the availability of electricity in the industrial world, as well as much of the third world, alternative means for lighting one's residence and dwelling are still used. One of the most common forms of simple economical lighting of rooms in a house is by the use of candles. Candles come in a variety of shapes and scents, and can have both utilitarian and decorative aspects. One primary utilitarian use of candles is for lighting a room when the electricity has gone off. Another utilitarian use of candles is for providing light in a small room where activities can still be conducted without the need for glaring high wattage overhead lights. The decorative aspect to the use of candles comes into the forefront during various holiday seasons and religious celebrations and events. The use of candles to illuminate a religious display or holiday decoration is both appealing and deeply evocative of the emotions and sentiments that attend such religious displays or holiday decorations.

However, there remains the perennial problem of successfully lighting the candlewick of the candle without burning one's fingers or hand. In addition, many types of candles have the candlewick set within and surrounded by the candleholder; often the upper rim of the candleholder is higher than the candlewick; or, conversely, the candlewick is set deeply within the candleholder. Thus, the match must be disposed at an angle and lowered below the upper rim of the candleholder to light the candlewick. This invariably leads to the flame of the instantly lighted candlewick burning up the match stem and causing the individual to drop the match after only one candlewick has been lit, and before one can starting lighting any other candles. The prior art thus discloses a variety of devices to obviate these problems.

For example, the Bell patent (U.S. Pat. No. 2,510,854) discloses a match-igniting device that includes a match slidably disposed on a shaft and which is ignited by striking a striker plate located at one end of the shaft.

The Smith patent (U.S. Pat. No. 2,785,556) discloses a device for lighting and extinguishing candles that includes a container holding an inflammable liquid with a tubular support upwardly projecting from the container and diverging into two opposed conduits one of which terminates with a bell-shaped snuffer and the other which terminates with a lighting element such as a wick.

The Nunemaker patent (U.S. Pat. No. 3,985,492) discloses a combination candle lighter and extinguisher that includes a substantially straight rod having a flame extinguisher at one end and a match holder at the opposite end.

The Zuffoletti patent (U.S. design Pat. No. 330,784) discloses a design for a combined candle lighter and snuffer that includes a handle, a rod, and a pair of smaller rods diverging from the rod with one of the smaller rods terminating with a snuffer and the other smaller rod terminating with a lighter.

The Phare patent (U.S. Pat. No. 5,344,309) discloses a candle lighting and extinguishing device that includes a hollow tubular shaft communicating with a squeeze bulb at one end and at the opposite end are two diverging tubular arms one of which is in communication with the pneumatic squeeze bulb and the other terminating with a fuel impregnated wick member.

The Rubino patent (U.S. design Pat. No. 406,409) discloses a design for a candle snuffer that includes a pair of elongated members connected at their medial end and spaced from each other at their distal ends with their distal ends in the form of hands with each hand holding a heart-shaped member so that pressing the heart-shaped member together snuffs out the candle.

Nonetheless, despite the ingenuity of the above devices, there remains a need for a two-way or dual use device that allows one to both light a candle and snuff out a candle from various angles of approach while at the same time keeping one's hand and fingers away from the flame of the lit candle.

SUMMARY OF THE INVENTION

The present invention comprehends a portable, durable, lightweight device for lighting candles and snuffing out candles, and more particularly comprehends a dual use, or two-way tool, for lighting candlewicks, including candlewicks of candles mounted in deep candle holders, and for snuffing out and extinguishing the flame of the candlewick when desired.

The two-way tool of the present invention comprises an elongated arcuate hollow tubular member further defined by a snuffing portion, a bight portion, and a rectilinear candle lighting portion. The tubular member is preferably of copper and may be finished or surfaced to simulate a handmade, antique appearance. The snuffing portion terminates at a snuffing end and the candle lighting portion terminates with a stationary secondary jaw. The secondary jaw includes an arcuate mouth, and integrally formed on the mouth of the secondary jaw is a semi-circular front notch and a pair of opposed side notches with the side notches axially aligned with each other and transverse to the longitudinal extension of the candle-snuffing portion. The snuffing end of the snuffing portion of the tubular member terminates with a candle-snuffing member in the form of a cone- or bell-shaped reducing member. The reducing member includes an internal cavity that encompasses the candlewick and flame when the reducing member is placed over the candlewick and flame for covering and then extinguishing the flame.

A primary jaw is pivotally mounted to the candle lighting portion adjacent the secondary jaw for coacting engagement with the secondary jaw to hold the match for lighting the candlewick, and for releasing the match for disposal after the lighting of the candlewick. The primary jaw is pivotally mounted to the candle lighting portion of the tubular member by a collar. The collar includes an upper bracket that encompasses and holds the primary jaw, and a lower stationary bracket that wraps around the candle lighting portion of the tubular member adjacent the secondary jaw. A pivot pin pivotally interconnects the upper bracket to the lower bracket so that the primary jaw can pivot with respect to the non-moving secondary jaw. The primary jaw includes a mouth portion, and the mouth portion includes a frontal semi-circular recess and a pair of opposed semi-circular side jaw recesses. The semi-circular recesses of the primary jaw mate with the semi-circular notches of the secondary jaw thereby forming three match holding apertures, more specifically designated a frontal match holding aperture for holding the match straight on to the candlewick, and a pair of opposed side match holding apertures for holding the match at 90 degrees relative to the candlewick. The side match holding apertures are especially useful for lighting candlewicks of candles emplaced in deep candleholders. A return and release spring is mounted on the tubular member adjacent the collar and engages the primary jaw so that pressing down on the primary jaw in the area above the return and release spring pivots the primary jaw away from the secondary jaw and opens the primary jaw for placement of the match in one of the selected match holding apertures. Loosening or releasing one's grip from the primary jaw causes the release and return spring to axially expand forcibly pivoting the primary jaw downward for closure against the secondary jaw thereby shutting the jaws and holding the match in position for lighting the desired candle.

It is an objective of the present invention to provide a two-way tool for lighting and snuffing out candles that allows for a safe and handy way to use candles in various situations and on various occasions.

It is another objective of the present invention to provide a two-way tool for lighting and snuffing out candles that provides for both actions in one tool.

It is yet another objective of the present invention to provide a two-way tool for lighting and snuffing out candles that prevents the fingers from getting burnt when lighting the candles and avoids having smoke get in one's face when snuffing out the candles.

It is still yet another objective of the present invention to provide a two-way tool for lighting and snuffing out candles that is manufactured from copper for durability and for giving the tool an appealing aesthetic appearance.

Still yet another objective of the present invention is to provide a two-way tool for lighting and snuffing out candles that has an external appearance simulating that of a handmade, antique item.

Still yet a further objective of the present invention is to provide a two-way tool for lighting and snuffing out candles that allows an individual to light candles straight on and from an angle of 90 degrees.

A still further objective of the present invention is to provide a two-way tool for lighting and snuffing out candles that allows one to hold the match for lighting the candle and release the match for disposal after lighting by the application and release of thumb pressure.

A further objective of the present invention is to provide a two-way tool for lighting and snuffing out candles that holds both wooden stick matches and paper matches without bending or damaging either type of matches.

Another objective of the present invention is to provide a two-way tool for lighting and snuffing out candles wherein the hands and fingers of the individual are not above the flame but are located away from the flame when the tool is being used.

These and other objects, features, and advantages will become apparent to those skilled in the art upon a perusal of the following detailed description read in conjunction with the accompanying drawing figures and appended claims.

DETAILED DESCRIPTION OF THE PREFERRED EMBODIMENT

Figure 1:
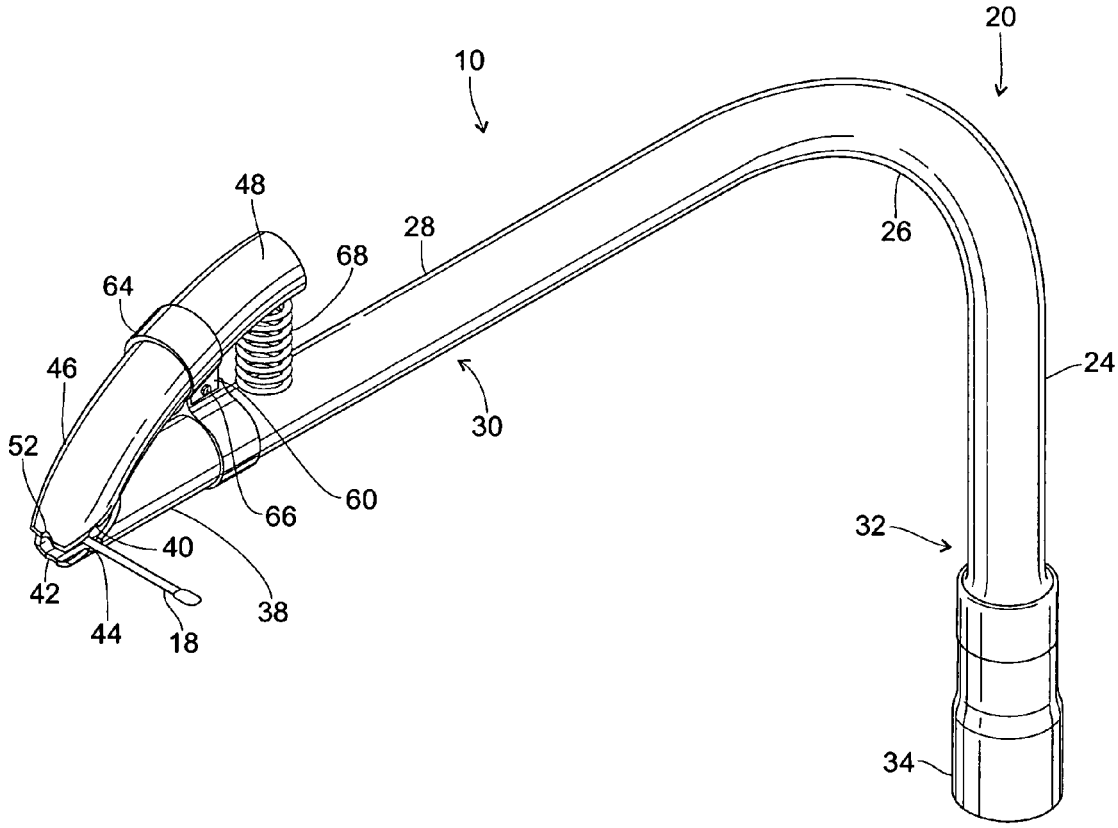
FIG. 1 is a perspective view of the two-way tool for lighting and snuffing out candles of the present invention illustrating the tool holding a match at an angle of 90 degrees relative to the longitudinal orientation of the substantially rectilinear and elongated portion of the tool.
Figure 2:
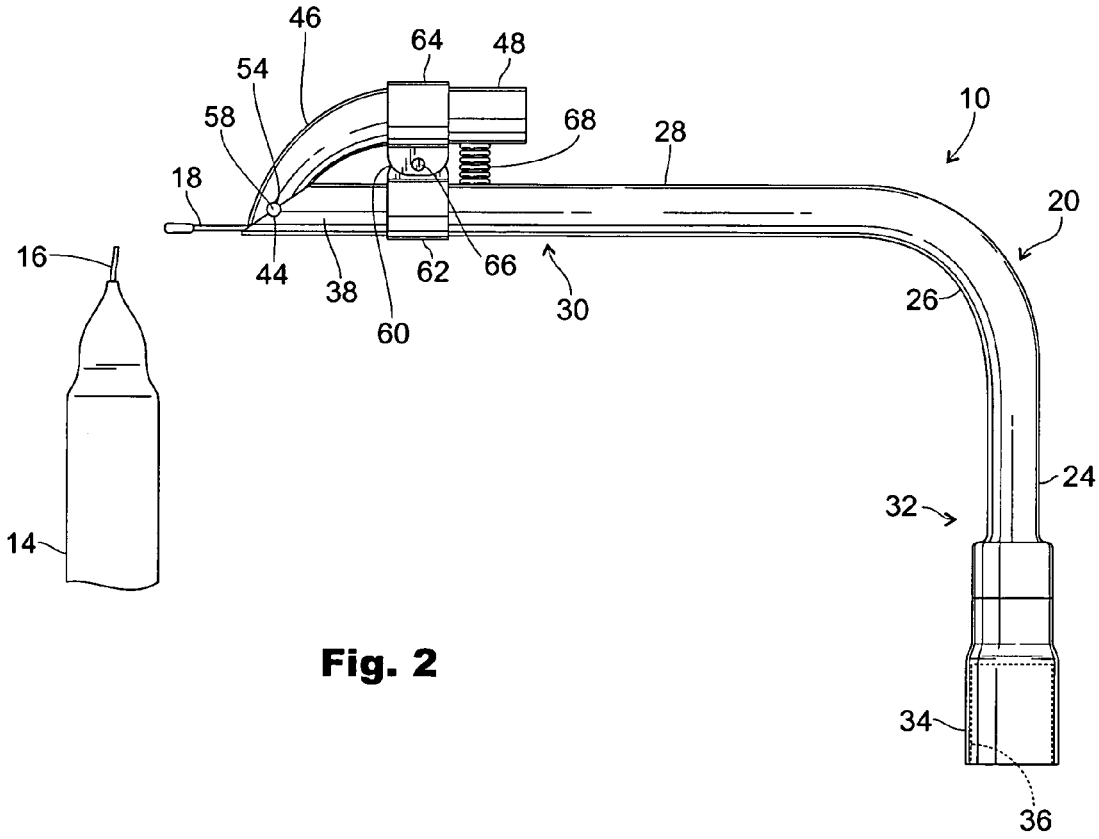
FIG. 2 is a side elevational view of the two-way tool for lighting and snuffing out candles of the present invention illustrating the jaws of the tool holding the match at an orientation that is straight on with regard to the candlewick and parallel with the substantially rectilinear and elongated portion of the tool.
Figure 3:
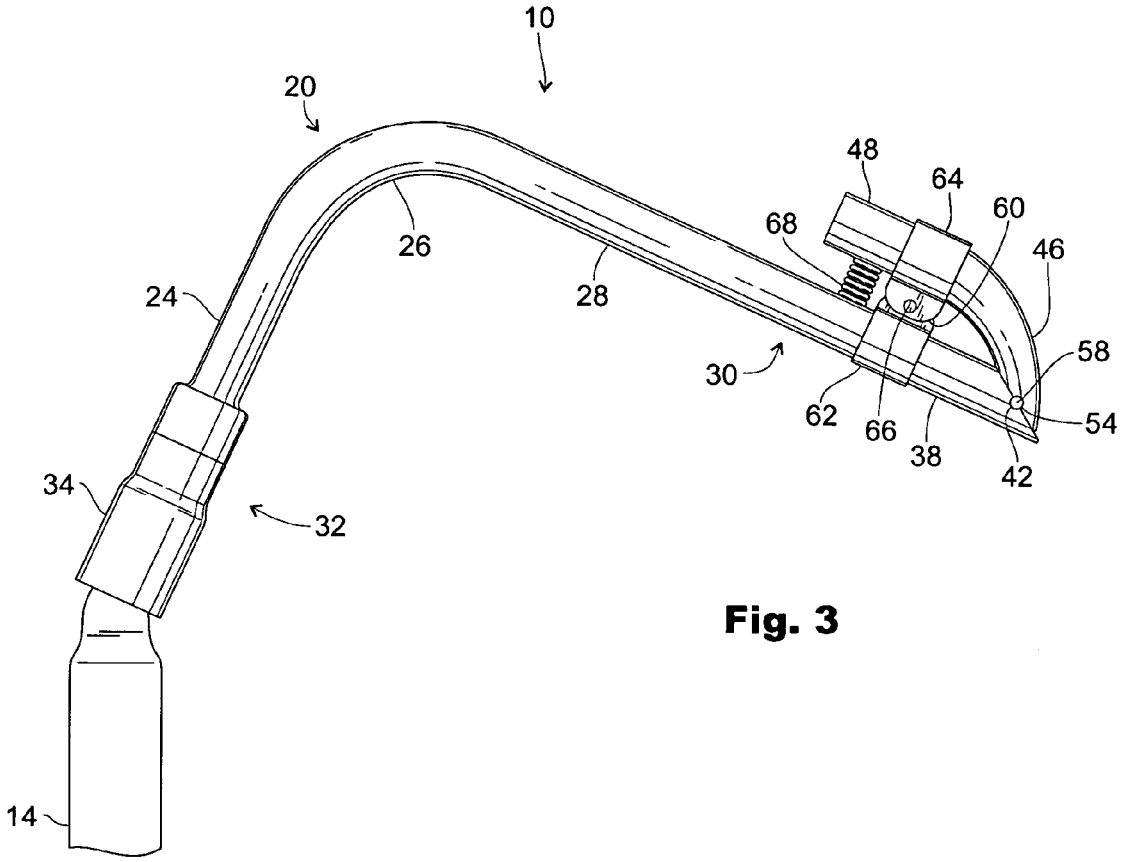
FIG. 3 is a side elevational view of the two-way tool for lighting and snuffing out candles of the present invention illustrating the candle-snuffing end placed upon the candlewick for extinguishing the candle flame.
Figure 4:
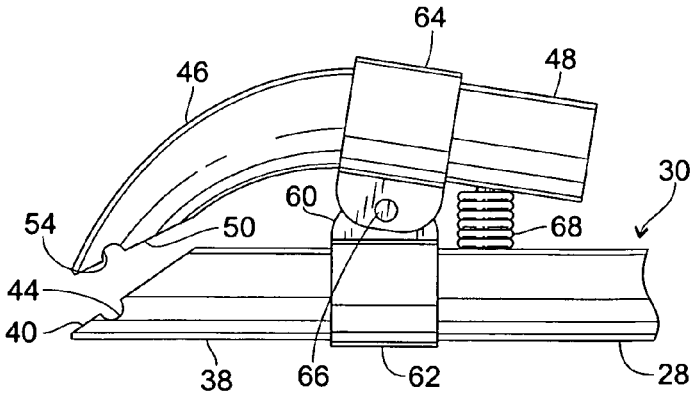
FIG. 4 is a enlarged sectioned side elevational view of the two-way tool for lighting and snuffing out candles of the present invention illustrating the disposition of the jaws in the open state prior to clamping down on the match for holding the match between the jaws or after the jaws have been released for release and disposal of the match.
Figure 5:
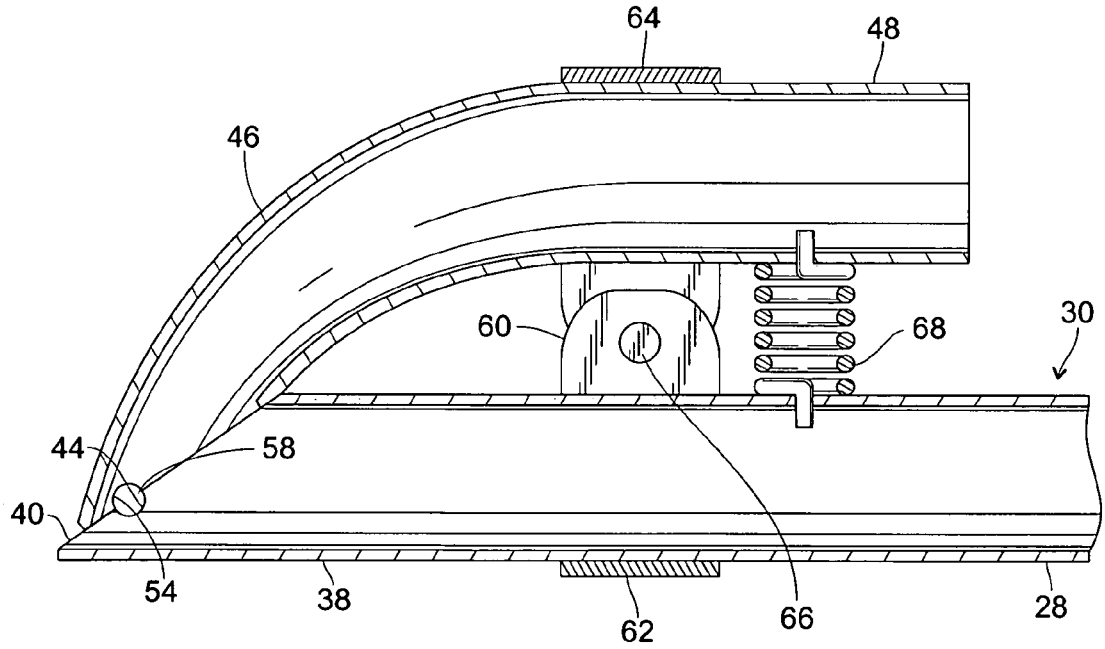
FIG. 5 is an enlarged sectioned side elevational view of the two-way tool for lighting and snuffing out candles of the present invention illustrating the disposition of the jaws in the closed or clamping state for holding the match between the jaws.

Illustrated in FIGS. 1-8 is a dual use or two-way tool 10 for lighting a candlewick of a candle and for extinguishing the flame of the lit candle. The two-way tool 10 of the present invention allows an individual to light candles of various sizes, designs and dimensions, and from various angles and orientations, ranging from straight on to 90 degrees with respect to the candlewick. The two-way tool 10 is especially useful for lighting deep candleholders wherein the candlewicks are set beneath the upper rim of the candleholder. Typically when lighting candlewicks in such deep candleholders while holding the match straight on and downwardly with respect to the candlewick, the flame will burn the match up before the individual can light any additional candles. The two-way tool 10 of the present invention allows the individual to light candlewicks emplaced in deep candle holders by holding the match at a 90 degree orientation with respect to the candlewick while angling the tool partially down into the deep candle holder. For representative purposes a candleholder 12 containing a candle 14 and candlewick 16 in the process of being lit by a match 18 are illustrated in FIGS. 1-8.

Figure 6:
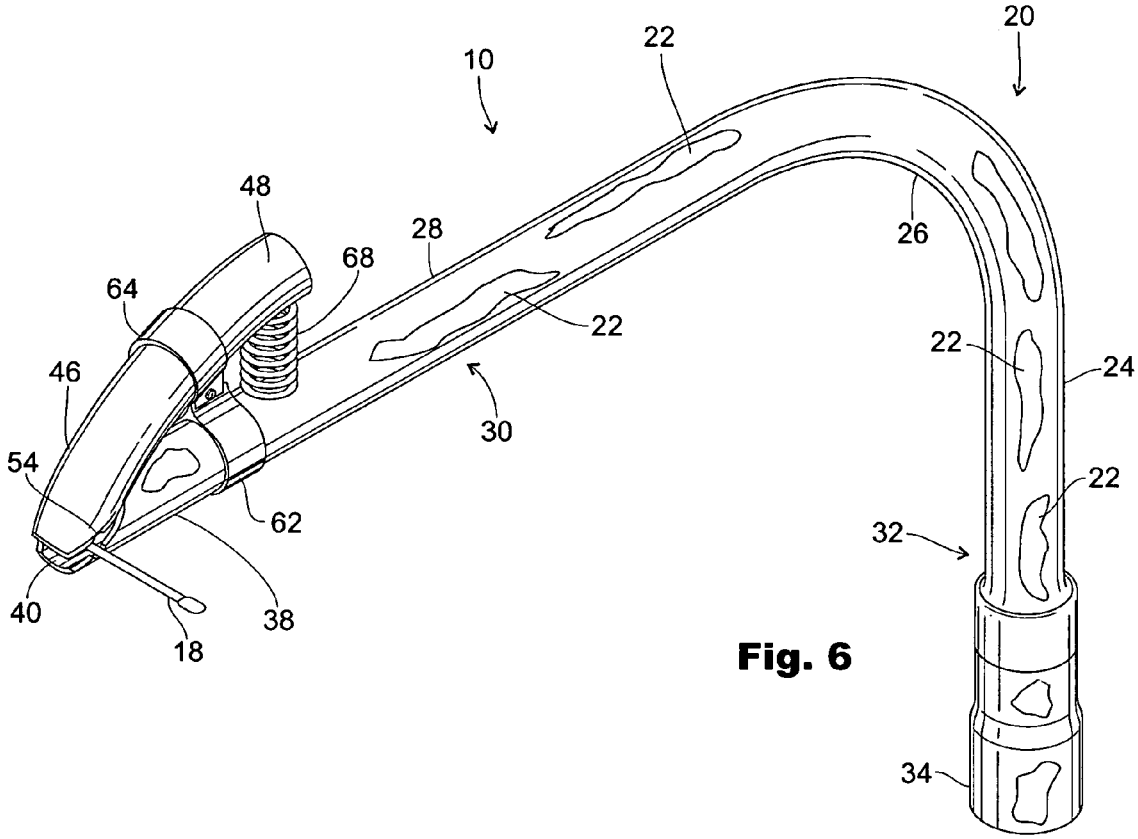
FIG. 6 is a perspective view of the two-way tool for lighting and snuffing out candles of the present invention illustrating the external surface of the tool decorated and finished to give the appearance of a handmade, antique object.
Figure 7:
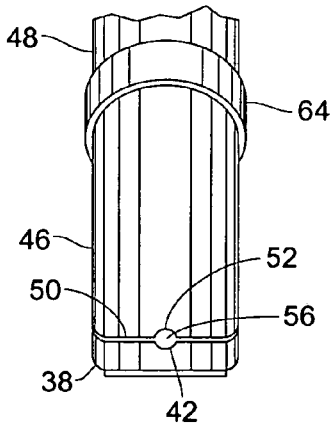
FIG. 7 is a front elevational view of the two-way tool for lighting and snuffing out candles of the present invention illustrating the aperture at the front of the jaws for holding matches, and especially paper matches without bending or damaging the paper matches.

As shown in FIGS. 1-8, the two-way tool 10 of the present invention includes an elongated hollow arcuate tubular member 20 preferably composed of copper for longevity and durability. In order to enhance the visual appeal of the tool 10, the external surface of the tubular member 20 can be worked and finished so that the tool simulates an antique, handmade appearance 22 as shown in FIG. 6. The tubular member 22 is further defined by a hollow cylindrical candle snuffing or extinguishing portion 24, a hollow bight portion 26, and a hollow cylindrical rectilinear candle lighting portion 28. The candle extinguishing portion 24, the bight portion 26, and the candle lighting portion 28 are preferably of uniform diameter. The candle extinguishing portion 24 and the candle lighting portion 28 define longitudinal axes, with the respective longitudinal axes—and the candle extinguishing portion 24 and candle lighting portion 28—being disposed and extending at an orientation that is at a right angle or perpendicular to each other. In addition, the candle lighting portion 28 is further defined by a match holding and releasing end 30, and the candle extinguishing portion 24 is further defined by a candle extinguishing or snuffing end 32.

As shown in FIGS. 1-3, 6 and 8, attached to the snuffing end 32, either integrally formed thereto or threadably secured thereto, is a cone- or bell-shaped reducing member or candle extinguishing member 34. The cone-shaped reducing member 34 has an outside diameter that is greater than the outside diameter of the candle extinguishing portion 24 on which it is mounted and extends thererfrom. The cone-shaped reducing member 34 is mounted to the snuffing end 32 of the candle extinguishing portion 24 so that the cone-shaped reducing member 34 is in axial alignment with the candle extinguishing portion 24. The cone-shaped reducing member 34 includes an internal cavity or socket 36 sized to fit over and cover the upper ends of candles, such as the candle 14 and candlewick 16 shown in FIGS. 2 and 3.

As illustrated in FIGS. 1-8, a secondary jaw 38 is integrally formed at the match holding and releasing end 30 of the candle lighting portion 28 of the tubular member 20. The secondary jaw 38 is a non-movable element and includes an arcuate mouth 40, and a frontal semi-circular notch 42 and a pair of oppositely disposed side or lateral notches 44. The side notches 44 are axially aligned with each other. The match 18 can be placed within any of the notches 42 and 44, and held therein with the cooperation and engagement of elements hereinafter further described.

The secondary jaw 38 cooperates with a primary jaw 46 to hold the match 18 within the jaws 38 and 46 and release the match 18 for disposal after the candle 14 or candles have been lit. The primary jaw 46 is a tubular generally curvilinear member that is pivotal and movable relative to the stationary secondary jaw 38. The primary jaw 46 includes a thumb tab portion 48 that is pressed by the thumb of the individual for selectively opening and closing the primary jaw 46 with respect to the secondary jaw 38. The primary jaw 46 also includes an arcuate primary jaw mouth 50, a frontal semi-circular recess 52 and a pair of opposed semi-circular side or lateral recesses 54. The oppositely disposed semi-circular side recesses 54 are in axial alignment with each other. As shown in FIGS. 1-5, when the primary jaw 46 is pivotally closed upon the secondary jaw 38, the respective semi-circular recesses 52 and 54 of the primary jaw 46 align with the respective semi-circular notches 42 and 44 of the secondary jaw 38 creating, in effect, a front aperture 56 and a pair of lateral apertures 58 for receiving and holding therein the match 18. The front aperture 56 allows the individual to light the candle 14 from an orientation that is straight on to the candlewick 16 while the lateral apertures 58 allow the individual to light the candle 14 from an orientation that is 90 degrees with respect to the candle 14. The mouth 40 of the secondary jaw 38 aligns with the mouth 50 of the primary jaw 46 so that secure closure of the jaws 38 and 46 is obtained.

As shown in FIGS. 1-8 the primary jaw 46 is pivotally mounted to the secondary jaw 38 for selective pivotal movement toward and away from the secondary jaw 38 by a collar 60. The collar 60 includes a lower cylindrical bracket 62 that snugly encompasses and is mounted to the match holding and releasing end 30 of the candle lighting portion 28 and is rearward of the secondary jaw 38. An upper bracket 64 snugly encompasses and is mounted to the primary jaw 46, and the stationary lower bracket 62 is pivotally interconnected to the upper bracket 64 by a pivot pin 66. The primary jaw 46 thus moves or pivots on the pivot pin 66.

Illustrated in FIGS. 1-8 is a return and release spring 68 that facilitates the closure of the primary jaw 46 upon the secondary jaw 38. The return and release compression or coil spring 68 is mounted adjacent and rearward of the lower bracket 62 and is seated upon the external surface of the tubular member 20 adjacent the match holding and releasing end 30 of the candle lighting portion 28 of the tubular member 20. The upper end of the return and release spring 68 contacts the underside of the thumb tab portion 48 of the primary jaw 46. In order to open the primary jaw 46 the individual merely depresses the thumb tab portion 48 thereby causing the primary jaw 46 to pivot upon the pivot pin 66 and away from the secondary jaw 38; and to close the primary jaw 46, the individual simply releases his or her grip or pressure upon the thumb tab portion 48 which immediately allows the spring 68 to expand and pivot the primary jaw 46 toward the secondary jaw 38 for closure upon the secondary jaw 38.

Figure 8:
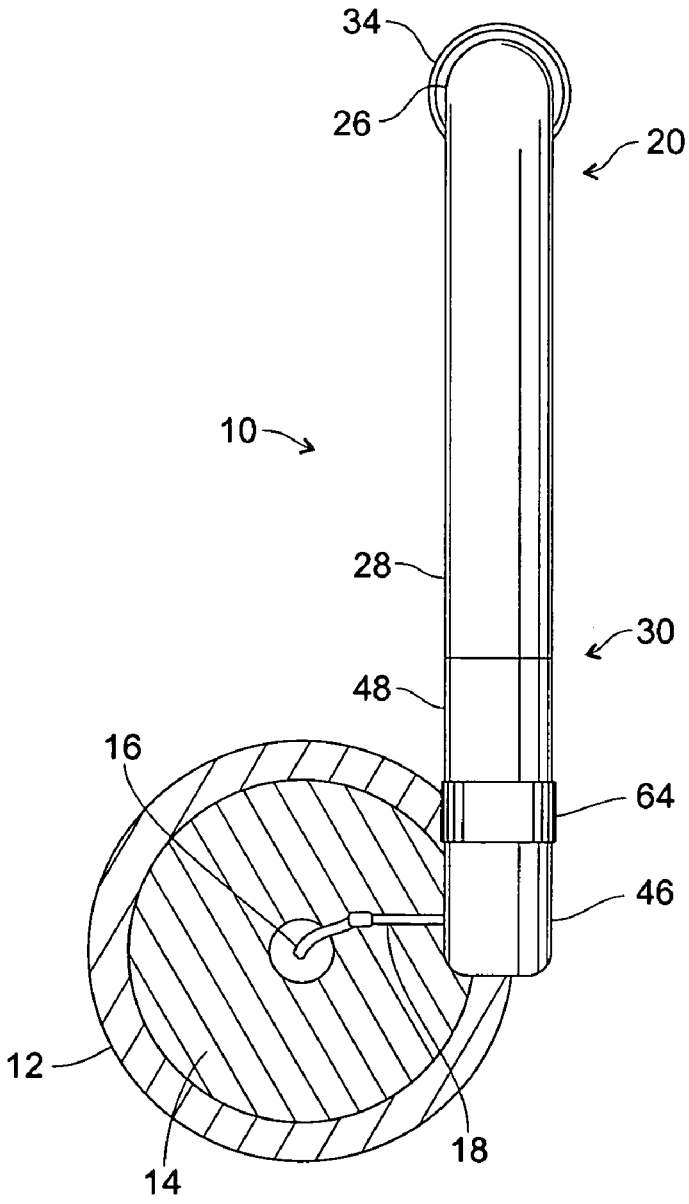
FIG. 8 is a top plan view of the two-way tool for lighting and snuffing out candles of the present invention illustrating the ability of the tool to securely hold the match at a 90 degree angle relative to the longitudinal extension of the candle lighting portion of the tool to facilitate lighting candles emplaced within deep candleholders.

FIG. 8 illustrates the match 18 being held in one lateral aperture 58 and between the primary and secondary jaws 38 and 46 for lighting the candle 14 at an orientation of 90 degrees. The candle lighting portion 28 of the two-way tool 10 is angled slightly down into the candleholder 12 for lighting the candle 14, and because the match 18 is lighting the candle 14 from the 90 degree orientation, the flame will not burn up the match 18, so this match 18 can be used to light other candles if so desired. In order to light the candlewick 16 of the candle 14, the individual would first press down upon the thumb tab portion 48 of the primary jaw 46 thereby compressing the spring 68 and simultaneously pivoting and opening the primary jaw 46. The match 18 would then be inserted into either the front or one of the lateral notches 42 or 44 of the secondary jaw 38, and then the individual would release his or her thumb from the thumb tab portion 48 thereby allowing the primary jaw 46 to forcibly pivot down and close upon the secondary jaw 38 through the expansion of the spring 68 resulting in the securement of the match 18, either a wooden match or a paper match, within the respective match holding aperture 56 or 58, and between the jaws 38 and 46, for lighting the candle 14. In order to extinguish the flame of the candlewick 16, the two-way tool 10 would be reversed or turned around so that the cavity 36 of the cone-shaped reducing member 34 can be placed upon and covering the upper end of the candle 14 and the candlewick 16 thereby extinguishing the flame. After a number of uses the cavity 36 may become coated with a thin wax film, and this wax film can be removed by gently scraping the wax film off with a knife.

The foregoing is considered as illustrative only of the principles of the invention, and as numerous modifications, alterations, and variations will readily occur to those skilled in the art, it is not desired to limit the invention to the exact construction and operation shown and described, and accordingly, all suitable modifications and equivalents thereof may be resorted while falling within the spirit of the invention and the scope of the appended claims.

What is claimed is:

1. A two-way tool for holding a match for lighting a candlewick of a candle and for extinguishing the flame of the candlewick of the candle, comprising:

an elongated arcuate hollow tubular member;

the tubular member further defined by a candle snuffing portion, a bight portion, and a rectilinear candle lighting portion;

the candle lighting portion terminating in a match holding and releasing end;

a cone-shaped reducing member mounted to and in axial alignment with the candle snuffing portion and having a diameter greater than the diameter of the candle snuffing portion, the cone-shaped reducing member for placement over the lighted candlewick to extinguish the flame of the candlewick;

a secondary jaw integrally formed at the match holding and releasing end of the candle lighting portion;

the secondary jaw including an arcuate mouth, and the mouth including a frontal semi-circular notch, and a pair of opposed semi-circular side notches;

a collar including a lower bracket mounted to the candle light portion adjacent the secondary jaw and an upper bracket with the upper bracket pivotally mounted to the lower bracket;

a primary jaw mounted to the upper bracket for pivotal movement thereon so that the primary jaw can be pivotally closed upon the secondary jaw and pivoted upwardly from the secondary jaw for opening the primary jaw;

the primary jaw including a primary jaw mouth, and the primary jaw mouth including a frontal semi-circular recess and a pair of opposed semi-circular side recesses;

the recesses of the primary jaw being brought in alignment with the notches of the secondary jaw when the primary jaw is closed upon the secondary jaw;

a return and release spring mounted to the candle lighting portion of the tubular member adjacent the collar and engaging the primary jaw so that depressing the spring causes the primary jaw to pivot away from the secondary jaw thereby opening the primary jaw and releasing of the spring causes the primary jaw to pivot toward the secondary jaw resulting in the closing of the primary jaw upon the secondary jaw; and whereupon the match can be held within any of the respectively aligned notches and recesses of the secondary jaw and primary jaw by the closure of the primary jaw upon the secondary jaw so that the candlewick can be lit by the match from an orientation that is straight on to the candlewick and from an orientation that is at 90 degrees to the candlewick, and then after lighting the candlewick the match can be released for disposal by depressing the release and return spring for pivoting and opening the primary jaw resulting in the release of the match.

2. The two-way tool for lighting and extinguishing candles of claim 1 wherein the rectilinear candle lighting portion is in axial alignment with the secondary jaw.

3. The two-way tool for lighting and extinguishing candles of claim 2 wherein the frontal semi-circular notch of the secondary jaw and the frontal semi-circular recess of the primary jaw are axially aligned with the rectilinear candle lighting portion when the primary jaw is closed upon the secondary jaw.

4. The two-way tool for lighting and extinguishing candles of claim 3 wherein the hollow tubular member is composed of copper.

5. The two-way tool for lighting and extinguishing candles of claim 4 wherein the tubular member can have an external finish for simulating a handmade, antique appearance.

6. The two-way tool for holding a match for lighting a candlewick of a candle and for extinguishing the flame from the candlewick, comprising:

an elongated arcuate hollow tubular member;

the tubular member further defined by a cylindrical candle extinguishing portion, a cylindrical bight portion, and a cylindrical candle lighting portion;

the candle lighting portion of the tubular member terminating in a match holding and releasing end;

a cone-shaped candle extinguishing member mounted to the candle extinguishing portion and in axial alignment therewith, the cone-shaped candle extinguishing member having a diameter greater than the diameter of the candle extinguishing portion, and the candle extinguishing member placed over the candlewick for extinguishing the flame of the candlewick;

a secondary jaw integrally formed to the candle lighting portion at the match holding and releasing end and in axial alignment with the candle lighting portion;

the secondary jaw having an arcuate mouth;

a collar including a lower bracket mounted to the match holding and releasing end of the candle lighting portion and an upper bracket pivotally interconnected to the lower bracket;

a primary jaw mounted to the upper bracket for pivotal movement therewith so that the primary jaw can be selectively closed upon the secondary jaw and selectively opened therefrom;

a front match holding aperture and a pair of opposed side match holding apertures formed when the primary jaw is closed upon the secondary jaw with the front match holding aperture for holding the match in an orientation that is straight on to the candlewick and the side match holding apertures for holding the match at 90 degrees to the candlewick;

a return and release spring mounted to the candle lighting portion of the tubular member and adjacent the match holding and releasing end and engaging the primary jaw so that depressing the spring causes the primary jaw to pivot away from the secondary jaw and releasing the spring causes the primary jaw to pivot toward the secondary jaw thereby closing the primary jaw upon the secondary jaw for holding the match in place within the front match holding aperture or either of the side match holding apertures; and whereupon the match is held within the front match holding aperture or the side match holding apertures as a result of the primary jaw closing upon the secondary jaw so tat the candlewick can be lit from the orientation that is straight on to the candlewick or at 90 degrees relative to the candlewick and alter lighting of the candlewick the match is released for disposal by depressing the release and return spring thereby pivoting the primary jaw away from the secondary jaw opening the primary jaw for removal and disposal of the match.

7. The two-way tool for lighting and extinguishing the candlewick of the candle of claim 6 wherein the front match holding aperture is in axial alignment with the candle lighting portion of the tubular member.

8. The two-way tool for lighting and extinguishing the candlewick of the candle of claim 7 wherein the side match holding apertures are in axial alignment with each other.

9. The two-way tool for lighting and extinguishing the candlewick of the candle of claim 8 wherein the hollow tubular member is composed of copper.

10. The two-way tool for lighting and extinguishing the candlewick of the candle of claim 9 wherein the tubular member is provided with an external finish that stimulates a handmade, antique appearance.

11. A two-way tool for holding a match for lighting a candlewick of a candle and for extinguishing the flame from the candlewick, comprising:

an elongated arcuate hollow tubular member;

the hollow tubular member further including a cylindrical candle extinguishing portion, a cylindrical bight portion, and a cylindrical candle lighting portion;

the hollow tubular member further defined by a match holding and releasing end and an opposite candle extinguishing end;

a cone-shaped candle extinguishing member mounted to the hollow tubular member at the candle extinguishing end for placement over the candlewick in order to extinguish the candlewick;

a secondary jaw integrally formed from the hollow tubular member at the match holding and releasing end and the secondary jaw being in axial alignment with the candle lighting portion;

a primary jaw mounted to the hollow tabular member adjacent the secondary jaw for pivotally engaging the secondary jaw;

a collar for pivotally interconnecting the primary jaw to the secondary jaw;

the collar further including a lower bracket mounted to the hollow tubular member adjacent the match holding and releasing end and an upper bracket pivotally attached to the lower bracket and on which the primary jaw is mounted for pivotal movement therewith;

a return and release spring interconnecting the primary jaw with the secondary jaw and facilitating the pivotal movement of the primary jaw;

the hollow tubular member being composed of copper;

the hollow tubular member further including an external finish that simulates a handmade, antique appearance; and whereupon the match is held between the primary jaw and the secondary jaw so that the match can light the candlewick from an orientation that is straight on to the candlewick or from an orientation that is at 90 degrees to the candlewick, and after the candle is lit the match can be released for disposal by depressing the spring thereby opening the primary jaw and causing the primary jaw to pivot away from the secondary jaw and thus releasing the match for disposal.

* * * * *